US005101559A

United States Patent [19]

Gelpi et al.

[11] Patent Number: 5,101,559

[45] Date of Patent: Apr. 7, 1992

[54] METHOD FOR REPAIRING A STEAM GENERATOR TUBE

[75] Inventors: Angel Gelpi, Paris; Bernard Michaut, Lyons, both of France

[73] Assignee: Framatome, Courbevoie, France

[21] Appl. No.: 588,818

[22] Filed: Sep. 27, 1990

[30] Foreign Application Priority Data

Sep. 27, 1989 [FR] France ..... 89 12654

[51] Int. Cl.[5] ..... B23P 15/26

[52] U.S. Cl. ..... 29/890.031; 29/402.18; 29/458; 29/523

[58] Field of Search ..... 29/890.031, 402.09, 29/402.18, 458, 523; 427/234

[56] References Cited

U.S. PATENT DOCUMENTS

| | | | |
|---|---|---|---|
| 4,505,017 | 3/1985 | Schukei . | |
| 4,567,632 | 2/1986 | Peters et al. | 29/402.18 |
| 4,592,577 | 6/1986 | Ayres et al. | 29/890.031 |
| 4,696,723 | 9/1987 | Bosquet et al. | 29/402.18 |
| 4,783,890 | 11/1988 | Gaudin | 29/402.09 |
| 4,897,908 | 2/1990 | Henriksson | 29/890.031 |
| 4,960,650 | 10/1990 | Vigneron et al. | 29/523 |
| 5,008,996 | 7/1991 | Bonnard et al. | 29/890.031 |

FOREIGN PATENT DOCUMENTS

| | | |
|---|---|---|
| 0181250 | 5/1986 | European Pat. Off. . |
| 0244283 | 11/1987 | European Pat. Off. . |
| 0309078 | 3/1989 | European Pat. Off. . |
| 2565323 | 5/1984 | France . |

*Primary Examiner*—Irene Cuda

*Attorney, Agent, or Firm*—Pollock, Vande Sande & Priddy

[57] ABSTRACT

Repair of a steam generator tube is performed by crimping a tubular casing (18) in a zone (14) of the tube (12) in which a metallic coating (20) has been produced on the inner surface of the tube, for example by electrolytic deposition. The tubular casing (18) may consist of an attached sleeve (18), crimped in the tube (12). In the case of a tube crimped over only part of the length of the hole passing through the tube plate, the tubular casing may consist of the tube itself on which additional crimping is performed inside the hole which passes through the tube plate.

8 Claims, 3 Drawing Sheets

METHOD FOR REPAIRING A STEAM GENERATOR TUBE

FIELD OF THE INVENTION

The invention relates to a method for repairing a tube such as a steam generator tube crimped into a tube plate.

BACKGROUND OF THE INVENTION

Heat exchangers, such as steam generators and, in particular, the steam generators of pressurized-water nuclear reactors, generally comprise a bundle of tubes of great length and small diameter forming the exchange surface and permitting the heating and the vaporization of the feed water of the steam generator.

In an electronuclear power station whose reactor is cooled and moderated by pressurized water, the heat released by the nuclear reaction is removed from the core by the cooling fluid or primary fluid and is transferred in the steam generator to secondary water which, after vaporization, drives the turbo-generator sets of the power station. This secondary water is returned in liquid form into the steam generator, after passing through the condenser.

The exchange surface of a steam generator of a pressurized-water nuclear reactor consists of a large number of tubes (for example, 3,400 tubes for each one of the three steam generators of a 900 MW.e power station), inside which the primary fluid circulates. The secondary fluid comes into contact with the outer surface of the tubes.

The tubes have an internal diameter of approximately 20 mm and are fixed at each of their ends into bores passing through a tube plate of great thickness, this thickness being of the order of 550 mm.

The joint between the tube and the tube plate is provided by expansion of the tube in a corresponding bore passing through the plate and by a weld made at its lower end.

The expansion of the tube may be achieved substantially over the entire length of the bore passing through or, on the other hand, over only a part of this length.

The tubes of the bundle of a steam generator form not only the heat exchange surface between the primary fluid and the secondary fluid, but also a confinement wall for the primary fluid, fulfilling an extremely important function in respect of the operating safety of the nuclear installation.

In the case of a power station comprising a pressurized-water reactor of 900 MW.e power, the primary fluid is at a pressure in the region of 155 bars and at a temperature of 300° C. and the secondary fluid is at a pressure of 56 bars and at a temperature of 271° C.

The difference in pressure existing between the primary fluid and the secondary fluid results in a situation whereby deterioration of a tube of the bundle of the generator can lead to a leakage of primary fluid into the secondary fluid. The primary fluid is charged with radioactive substances in solution or in suspension and, consequently, even a small amount of leakage in a tube of the bundle of the steam generator leads to contamination of the secondary water and of the components of the power station in which this secondary water circulates. A defective operation regime of this type is unacceptable since the secondary fluid circulates outside the containment buildings of the nuclear reactor in the turbine set and in all the auxiliary circuits and apparatuses which are associated with this set.

The tubes of the bundle of a steam generator are designed and dimensioned so that they can be subjected, without damage, to the various mechanical and thermal loads which they undergo in service; the material from which they are made is defined in order to avoid, as far as possible, corrosion of these tubes by the fluids with which they come into contact.

Moreover, the chemical characteristics of the primary and secondary fluids are, during operation of the installation, continuously monitored and, if appropriate, rectified, in order to reduce corrosion risks.

However, it is necessary to continuously ensure that the tube bundle of the steam generator is in a satisfactory condition and completely separates the primary and secondary fluids. This monitoring is performed using continuous surveillance, during operation, of the level of activity in the secondary water, which makes it possible to detect leakages whose flow rate is very small. During periods of shutdown of the nuclear installation, the tubes of the bundle are examined, for example using eddy currents, in order to detect defects whose progression could subsequently lead to leakage.

Despite the various precautions taken both at the design and manufacturing stage and during operation of the steam generators, it became apparent that some materials used for manufacturing the tubes of the bundle were quite sensitive to stress corrosion. This applies particularly to some types of nickel-based alloys containing chromium and iron.

Stress corrosion principally develops in the zones where the tube is subject to residual stresses and, in these zones, a crack may form across the thickness of the tube, which is liable to result finally in leakage of primary fluid into the secondary fluid.

A zone which is particularly sensitive to this type of corrosion, in the case of a tube crimped along the entire length of a bore passing through the tube plate, is located at the level of the upper face of the tube plate. In fact, after being inserted into the tube plate and before its lower end is welded, the tube is subjected to an operation of crimping by diametrical expansion, known as widening or expansion by rolling, and which aims to ensure intimate contact between the outer surface of the tube and the surface of the bore pierced in the tube plate. Widening of the tube may take place over the entire height of the tube plate in order to eliminate the gap resulting from the diametrical play between the tube and the bore in the plate, this gap forming a semi-confined space in which concentrations of secondary water may occur, leading to considerable corrosion phenomena.

Crimping of the tube may also be performed over only part of the length of the bore passing through the tube plate, this partial crimping generally being performed in the vicinity of the end of the bore located towards the entry face of the tube plate.

When the tube is crimped, there remains in the wall of the tube a zone of transition between the part of the tube which is widened and in contact with the bore of the tube plate and the upper part of the tube which has not been subjected to diametrical expansion. In this transition zone, the tube is subject to residual stresses which, if the material is sensitive to stress corrosion, can give rise to intergranular cracking whose progression can lead to leakage of primary fluid across the thickness of the tube.

In order to remedy this drawback, methods have.. been proposed for thermal or mechanical stress relaxation of the wall of the tubes of the bundle of a steam generator in the transition zone.

However, it is also necessary to have available repair methods which can be implemented on steam generators whose tube bundle has already suffered stress corrosion.

The method which seems most satisfactory for performing this repair consists in sheathing a part of the inner surface of the tube such that the sheath or sheathing sleeve covers the crack through the wall of the tube or which risks breaching this wall.

The sheathing sleeve, whose diameter is smaller than the internal diameter of the tube, is placed in the desired position inside this tube and is subjected to diametrical expansion by widening which guarantees both the mechanical strength and the seal of the fixing of the sleeve. Widening may be performed over the entire height of the sleeve or only in two zones of this sleeve corresponding to its upper and lower ends.

The sheathing sleeve may also be brazed inside the tube or fixed by a weld bead at each of its ends.

In certain cases, one end, preferably the upper end, of the sleeve is fixed by widening in the tube and the other end of the sleeve is fixed by welding.

Even if the tube is not fixed by crimping, it is necessary to ensure contact between the sheathing sleeve and the tube by using a widening operation in order to eliminate the radial play between the sheathing sleeve and the tube and to perform brazing or welding under satisfactory conditions.

Known sheathing methods effectively make it possible to repair tubes with defects resulting from cracks caused by stress corrosion and to avoid leakages of primary fluid into the secondary fluid. However, it has been observed that, after a certain operating time of the tubes repaired in this way, the tube bundle again had a certain level of leakage detected by monitoring the radioactivity of the secondary water. On examination, it appeared that new defects had developed in the tubes, generally at the level of the upper end for fixing the sheath in the tube or in the immediate vicinity of this upper end.

The upper end of the sheathing sleeves which is located in the part of the tube which projects relative to the upper face of the tube plate and which is generally fixed by crimping inside the tube is located precisely in a zone where the tube is subject to a certain diametrical expansion and has a considerable concentration of stresses.

In the case of partial crimping of the tube, the transition zone is located above the crimped portion of the tube, inside the bore passing through the tube plate. Cracks usually appear in this transition zone. It is thus possible to envisage repairing the tube by crimping the tube itself, in the bore of the tube plate, above the transition zone.

However, there is a risk of new cracks subsequently appearing in the new transition zone created when complementary crimping of the tube is carried out.

A method described in FR-A-2,565,323 is known, which makes it possible to protect, against stress corrosion, a tube, such as a steam generator tube crimped into a tube plate and, in particular, the transition zone of this tube located in the vicinity of the exit face of the tube plate and corresponding to the separation zone between the expanded part of the tube inside the tube plate and the non-expanded part of the tube. This protection method consists in depositing, using electrolysis, a metallic layer on the inner surface of the tube after it has been fixed in the tube plate. The electrolytic coating makes it possible to insulate the inner surface of the tube, particularly in the zone where the wall of the tube has a high concentration of stresses, from the exchange fluid, such as the pressurized water circulated inside the tube.

However, a method of this type has never been used for repairing a tube by sheathing and involving deformation by diametrical expansion of the tube in its part projecting relative to the tube plate or in the case of partial repair of a crimped tube by complementary crimping above the transition zone.

SUMMARY OF THE INVENTION

The invention thus aims to propose a method for repairing a tube, such as a steam generator tube crimped into a tube plate, over at least part of the length of a hole passing through the tube plate and having inner and outer surfaces which come into contact respectively with a first and a second exchange fluid, the repair being performed by crimping a tubular casing, which may consist of the tube itself, inside the tube or the hole passing through the tube plate, so as to isolate at least one defective zone of the wall of the tube from one of the exchange fluids, this method making it possible to prevent the appearance of new cracks when the heat exchanger or steam generator is put back into service after repair.

To this end, prior to the insertion and the fixing of the sheathing sleeve in the tube, a metallic coating is produced on the inner surface of the tube, in a zone located downstream of the defective zone, in the direction of circulation of the first exchange fluid inside the tube, and the tubular casing is crimped in the zone of the tube in which the metallic coating is produced.

BRIEF DESCRIPTION OF THE DRAWINGS

In order to facilitate comprehension of the invention, a description will now be given, by way of example, of an embodiment of the method according to the invention in the case of a steam generator tube of a pressurized-water nuclear reactor crimped along the entire length of a bore passing through a tube plate and in the case of a tube crimped over part of the length of the bore.

DETAILED DESCRIPTION

Figure 1:
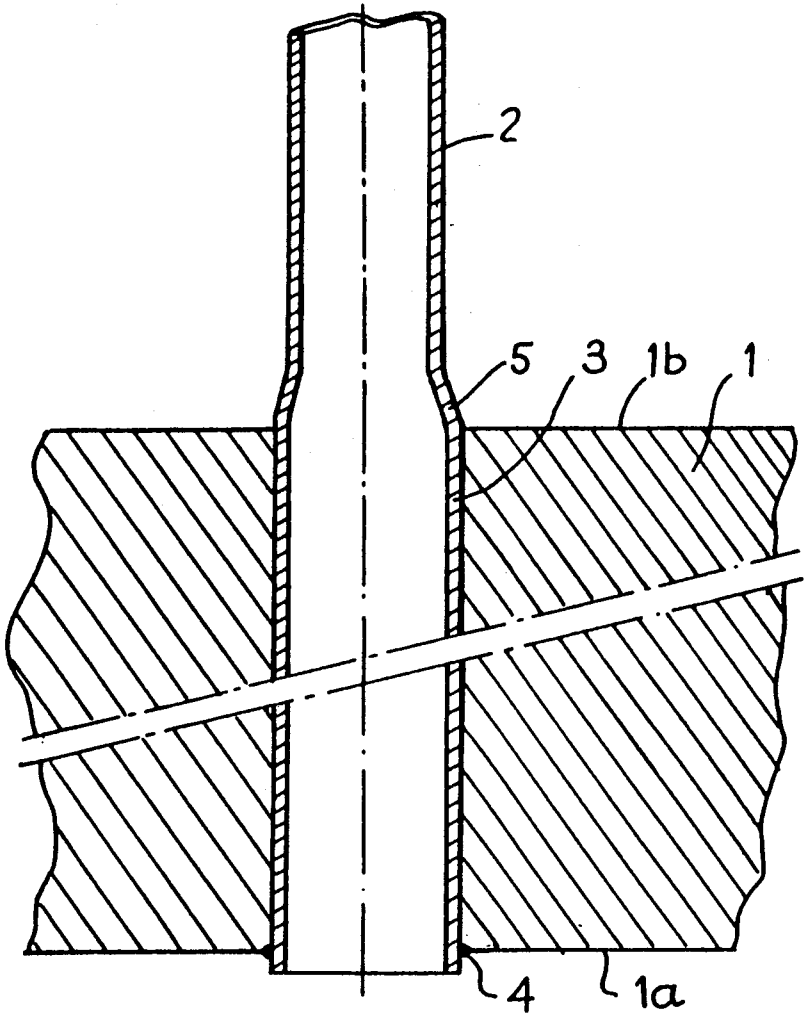
FIG. 1 is a sectional view in an axial plane of symmetry of a steam generator tube crimped into a tube plate along the entire length of a bore passing through the tube plate.

FIG. 1 shows the tube plate 1 of a steam generator having a great thickness, of the order of 550 mm, in which one end of a tube 2 of the bundle of the steam generator is fixed inside a bore 3 passing through the entire thickness of the tube plate between its entry face 1*a* and its exit face 1*b*. The tube 2 is fixed in the tube plate 1 so that it is practically flush with the entry face 1*a* and projects relative to the exit face 1*b* of the tube plate. The entry face 1*a* of the tube plate forms one of the walls of the water box of the steam generator into which the primary fluid, which is caused to circulate inside the tubes 2, penetrates.

The tubes 2 project relative to the exit face 1*b* of the tube plate which delimits the upper part of the steam generator in which the tube bundle is disposed.

The feed water of the steam generator penetrates into this upper part in order to come into contact with the outer surface of the tubes 2.

The ends of the tubes 2 of the bundle are fixed in the holes 3, which pass through the tube plate 1, by widening of the tube inside the bore 3, resulting in a diametrical expansion and crimping of the tube which is deformed in contact with the surface of the bore 3. The fixing and the seal of the tube 2 are completed by a weld joint 4 made at the level of the entry face 1*a* of the tube plate.

In the vicinity of the exit face 1*b* of the tube plate, the tube 2 has a transition zone 5 between the lower zone of the tube which is deformed by diametrical expansion and the upper zone of the tube which is not deformed. In this zone 5, the wall of the tube 2 has a high concentration of stresses which favors stress corrosion of the tube in the steam generator during operation.

Figure 2:
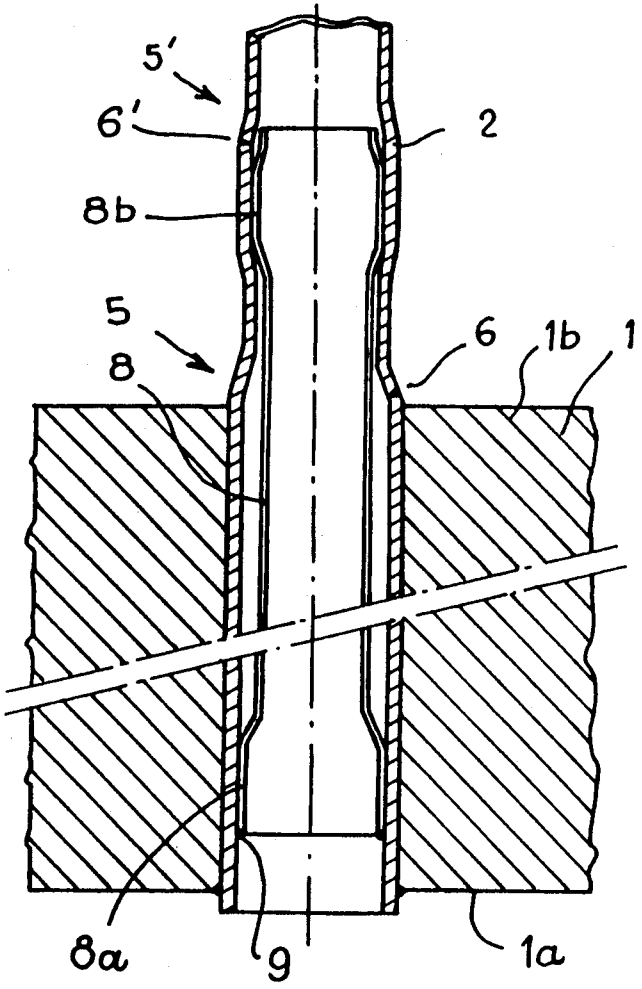
FIG. 2 is a sectional view in an axial plane of a steam generator tube, such as the tube shown in FIG. 1, comprising a sheathing sleeve fixed in the tube using a method according to the prior art.

In the case of steam generator tubes made from an alloy sensitive to this type of corrosion, for example a nickel-based alloy containing chromium and iron, the stress corrosion in the transition zone 5 may be high and may result in the formation of a crack 6 across the wall of the tube 2 in the transition zone 5, as may be seen in FIG. 2.

Progression of the crack 6 may lead to leakage of the primary fluid circulating in the tube 2 towards the part of the steam generator containing the feed water located above the plate 1*b*.

In this case, it is possible to repair the tube 2 by sheathing, as shown in FIG. 2.

A sheathing sleeve 8, whose external diameter is a few tenths of a millimeter smaller than the nominal internal diameter of the tube 2, is inserted in the tube 2 via its end flush with the entry face 1*a* of the tube plate in order to cover the zone with the crack 6 and, more generally, all the transition zone 5 of the tube 2 crimped in the tube plate 1.

The sheathing sleeve 8 is subjected to diametrical expansion in two end zones 8*a* and 8*b* by widening. This widening operation crimps the sleeve 8 inside the tube 2, on the one hand inside the tube plate 1 and, on the other hand, in the part of the tube 2 projecting relative to the exit face 1*b* of the tube plate.

In the part of the tube projecting relative to the tube plate, the diametrical expansion of the sleeve 8 in the zone 8*b* brings about contact between the sleeve 8 and the inner surface of the tube 2. The widening operation is continued until there is slight deformation due to diametrical expansion of the tube 2 at the level of the zone 8*b* of expansion of the sleeve 8. The stresses created in the tube 2 and the sleeve 8 produce a crimping, ensuring the fixing of the sleeve in the projecting part of the tube 2. The sealed fixing of the sleeve 8 is completed by a weld 9 at its lower end.

The deformation of the tube 2 at the level of the zone 8*b* of the sleeve causes the formation of a new transition zone 5' between a deformed part and a nondeformed part of the tube 2, in which the wall of the tube 2 has a high concentration of stresses.

During operation, in the steam generator, the tubes such as the tube 2 which have been sheathed are liable to have cracks 6' which generate leakage in the transition zones such as the zone 5'.

The presence of cracks 6' passing through may result in leakages of primary fluid into the secondary fluid.

Figure 3:
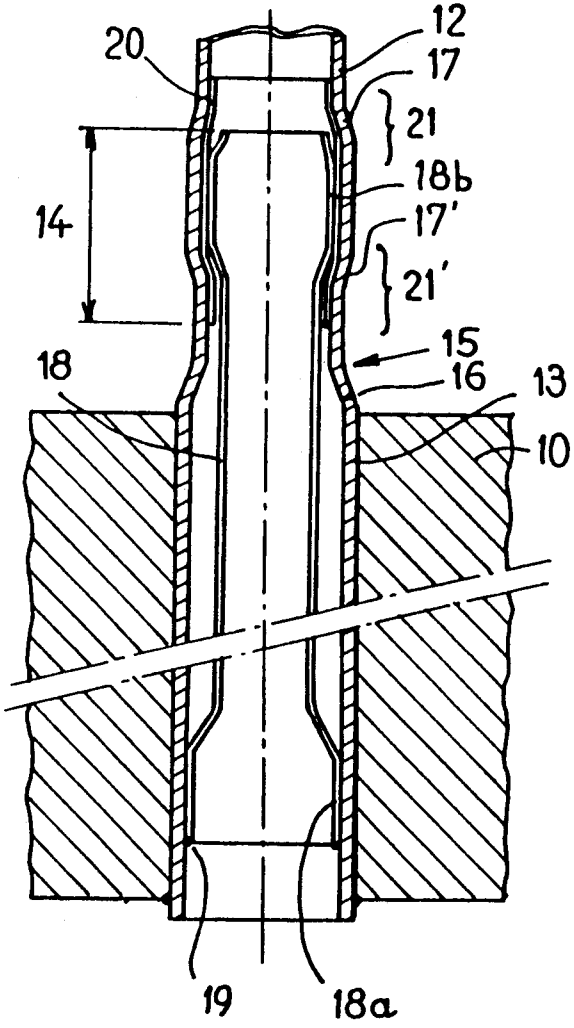
FIG. 3 is a sectional view in an axial plane of a steam generator tube, such as the tube shown in FIG. 1, comprising a sheathing sleeve fixed inside the tube using a method according to the invention.

The object of the method according to the invention, which will be described with reference to FIG. 3, is to prevent the formation of cracks due to stress corrosion in the zones of transition of the tubes of the steam generator which have been created during sheathing.

It should be noted that, even if the upper end of the sheathing sleeve 8 were fixed inside the tube 2 by welding or brazing, it is necessary to perform a widening in order to produce a diametrical expansion of the sleeve in the tube in order to obtain satisfactory contact between the sleeve and the inner surface of the tube. Although less than in the case of crimping the sleeve, this widening gives rise to the presence of stresses in a zone of the tube 2 and to the formation of a transition zone.

FIG. 3 shows the end of a tube 12 of a steam generator fixed by crimping and by welding in a bore 13 passing through a tube plate 10 of great thickness.

The tube 12 has undergone considerable stress corrosion in its transition zone 15 and a crack 16 generating leakage has formed in this zone 15.

During a shutdown of the power station in which the steam generator is used, the tube 12 is sheathed by using the method according to the invention.

Firstly, the inner surface of the tube 12 is cleaned and descaled in order to remove any trace of oxide from this surface in a zone 14 covering the upper zone for fixing a sheathing sleeve 18 which must be fixed by crimping in the part of the tube 12 projecting relative to the tube plate 10.

The position and the length of the zone 14 are defined as a function of the position of the crack 16 and of the transition zone 15 of the tube 12 and as a function of the length of the zone of the sleeve and of the tube which have to undergo diametrical expansion in order to produce efficient crimping of the upper part of the sleeve 18 inside the tube 12.

The zone 14 must at least cover the zone of the tube in which crimping of the upper part 18*b* of the sleeve will take place and the transition zones 17 and 17' on either side of the zone of the tube 12 deformed by diametrical expansion during crimping of the sleeve.

After cleaning of the zone 14, nickel is electrolytically deposited in this zone on the inner surface of the tube.

This electrolytic coating, of a thickness of the order of a tenth of a millimeter, may be performed by using a known device comprising plugs or seals for sealed closure of the tube on either side of the zone 14 and means for feeding the zone delimited by the plugs with electrolytic liquid, as well as means for supplying the electrolysis current to the zone 14.

After the electrolytic coating 20 has been produced, a sleeve 18, whose external diameter is a few tenths of a millimeter smaller than the internal diameter of the tube 12, is inserted into this tube in order to cover the crack 16 and the transition zone 15 of the tube 12, the upper end of the sleeve 18 being positioned inside the zone 14 previously coated with the electrolytic deposit 20 of nickel.

The sleeve 18 positioned in the tube 12 is diametrically expanded in its two end zones 18*a* and 18*b* in order to fix the sleeve 18 into the tube 12 by crimping.

In its part projecting relative to the plate 10, the tube 12 is deformed by diametrical expansion in accordance with the zone 18*b* for fixing the sleeve 18 by crimping. The zone of the tube 12 deformed by diametrical expansion and the two transition zones 17 and 17' coincide with the zone 14 of the tube in which the electrolytic coating 20 of nickel has been produced.

The electrolytic deposit 20 of nickel is sufficiently ductile and adherent to undergo the deformation which accompanies the expansion of the sleeve 18 and of the tube 12 without suffering any cracking or tearing.

Moreover, although it is deformed and has a certain concentration of stresses, the electrolytic layer 20 of nickel is not sensitive to stress corrosion under the conditions of use of the steam generator.

The coating 20 thus prevents the appearance of new cracks, such as the crack 6' shown in FIG. 2, in the steam generator during operation after sheathing of the tube 12 using the method according to the invention.

In fact, the primary fluid circulating in the zone 21 in the vicinity of the upper end of the sleeve 18 comes into contact with the layer 20 which is not sensitive to stress corrosion. This prevents new cracking of the tube in the transition zone 17.

The feed water of the steam generator which is liable to penetrate into the space existing between the tube 12 and the sleeve 18 via the cracked zone 16 comes into contact with the electrolytic coating 20 in the zone 21' in the vicinity of the lower end of the zone for fixing the sleeve 18 in the projecting part of the tube 12 by crimping. This prevents cracking due to stress corrosion, in particular in the transition zone 17'.

In this way, an effective protection of the tube in the upper crimping zone of the sleeve and in the transition zones is thus obtained.

Fixing of the sleeve may be completed by a circular weld 19 at its lower part.

It is also quite obvious that the sleeve could be fixed inside the tube, at each of its ends, by welding and brazing after diametrical expansion by widening to a lesser extent than is necessary to ensure crimping thereof.

In an advantageous manner, this operation of fixing by diametrical expansion followed by welding or brazing may be performed after producing an electrolytic coating on the inner surface of the tube in its part projecting relative to the tube plate receiving the upper part of the sheathing sleeve 18.

Figure 4:
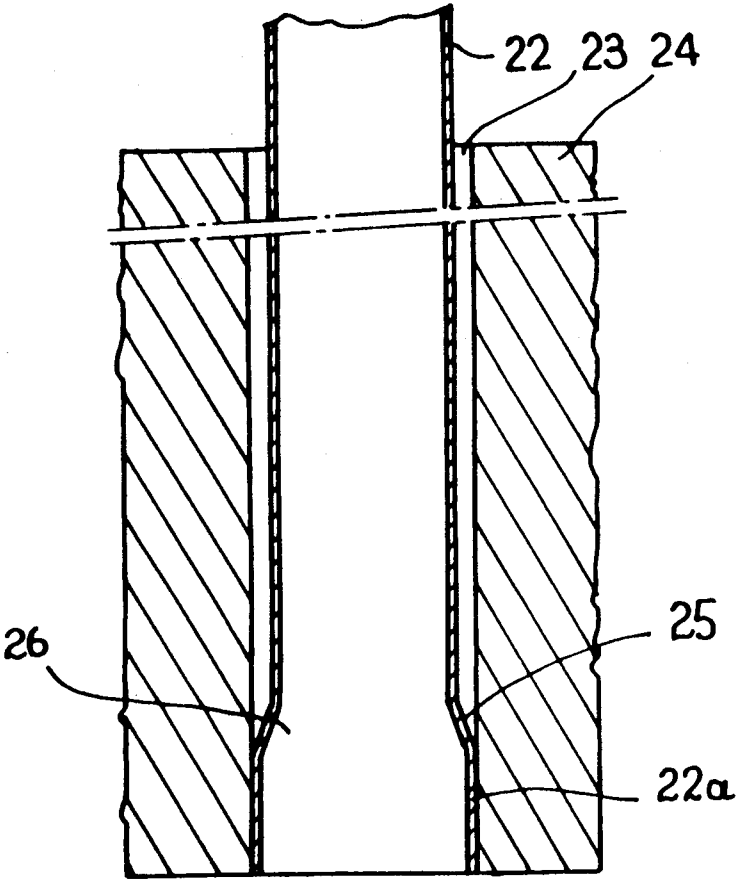
FIG. 4 is a sectional view of steam generator tube crimped into a tube plate over part of the length of a bore passing through the tube plate.

FIG. 4 shows the end of a tube 22 of a steam generator fixed by partial crimping into an opening 23 passing through the tube plate 24 of the steam generator.

Partial crimping of the tube 22 into the opening 23 is performed by diametrical expansion and widening of a part 22*a* of the tube 22 disposed in the vicinity of the entry end of the opening 23. Partial widening of the tube 22 in its part 22*a* leads to the formation of a transition zone 25 located between the widened part 22*a* and the non-deformed part of the tube 22. Cracks, such as 26, are likable to form in the transition zone 25 during operation of the steam generator.

Figure 5:
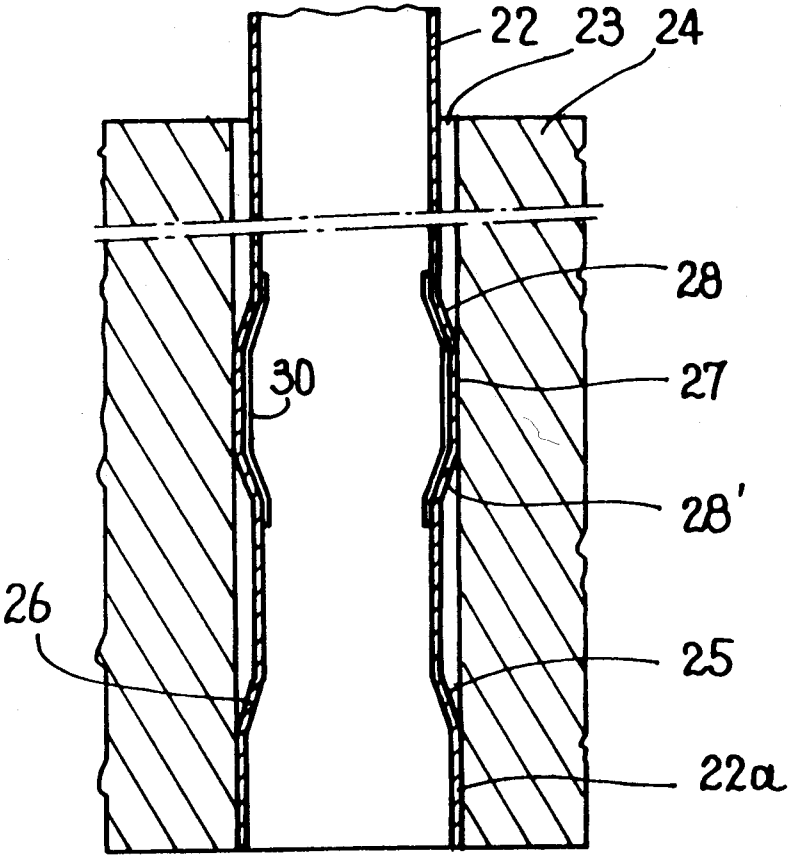
FIG. 5 is a sectional view of a tube, as shown in FIG. 4, after a repair made using a method according to the invention.

As may be seen in FIG. 5, the tube 22 may be repaired by performing an additional crimping of the tube 22 in a zone 27 located downstream of the crack 26 when considering the circulation of the primary fluid inside the tube 22. Crimping of the zone 27 of the tube into the opening 23 makes it possible to prevent any leakage of primary fluid into the part of the steam generator receiving the water to be vaporized which comes into contact with the outer surface of the tube 22 above the zone 27.

Additional crimping of the tube 22 leads to the formation of transition zones 28 and 28' on either side of the zone 27. In order to prevent the formation of cracks in the zones 28 and 28', according to the invention, an electrolytic nickel layer 30 is deposited on the inner surface of the tube 22, in the zone 27, prior to the additional operation of crimping by widening. Although deformed, the nickel layer 30 is not sensitive to stress corrosion and ensures the protection of the tube in the zones 28 and 28'.

It is also possible to perform the electrolytic deposition 30 of nickel, in the zone 27, after the operation of crimping by widening.

Instead of an electrolytic coating of nickel, as a function of the material of the tube to be repaired and its conditions of use, it is possible to deposit a coating made from another metal or, more generally, a coating of a suitable metallic chemical compound.

The thickness of the coating may differ by a tenth of a millimeter, as a function of the nature of the coating, of the size of the tube and of the geometrical characteristics of the sheathing sleeve.

In the case of a repair by sheathing, the zone in which the tube is cleaned, followed by its coating, may extend towards the base of the tube beyond the zone for fixing the sleeve and the corresponding lower transition zone.

The coating may be produced in a zone extending inside the tube plate so as to ensure increased protection of the tube against corrosion.

The tube may be repaired by crimping any tubular casing, it being possible for this casing to consist of the tube itself, in a zone of the tube in which a protective metallic coating is produced.

The invention applies not only in the case of steam generator tubes of pressurized-water nuclear reactors but also in the case of tubes located in other parts of the nuclear power station which come into contact with the primary fluid. In particular, the invention may be applied advantageously in the case of perforations penetrating the shroud of the pressurizer of a pressurized-water nuclear reactor.

More generally, the invention may be applied wherever tubes are subjected to stress corrosion.

We claim:

1. Method for repairing a tube (12, 11) crimped into a tube plate (10, 24), over at least part of a length of a hole (13, 23) passing through said tube plate and having inner and outer surfaces which come into contact respectively with a first and a second exchange fluid, said method comprising the steps of (a) crimping a tubular casing (18, 22) inside said tube (12, 22) or said hole (13, 23), so as to isolate at least one defective zone of a wall of said tube (12, 22) from one of said first and second exchange fluids;

(b) producing a metallic coating (20, 30) on the inner surface of said tube (12, 22), in a zone (14, 27) located downstream of said defective zone, in a direction of circulation of said first exchange fluid inside said tube (12, 22); and (c) crimping said tubular casing (18, 22) in said zone (14, 27) of said tube (12, 22) in which said metallic coating (20, 30) is produced.

2. Method according to claim 1, wherein said tube is repaired by sheathing, comprising the steps of (a) inserting into said tube a sheathing sleeve (18) having a diameter smaller than an internal diameter of said tube (12);

(b) diametrically expanding said sheathing sleeve (18) inside said tube (12);

(c) fixing said sheathing sleeve in said tube (12) by crimping and/or welding in at least one zone (18*b*) of said sleeve (18) located in a part of said tube projecting relative to said tube plate (10);

(d) prior to insertion and fixing of said sheathing sleeve (18) in said tube (12), producing said metallic coating (20) on said inner surface of said tube (12), in a zone (14) covering said zone (18*b*) for fixing said sleeve (18) in said part of said tube projecting relative to said tube plate (10);

(e) said sleeve (18) being crimped in contact with said metallic coating (20), thereby protecting said wall of said tube (12) against stress corrosion in said zone for fixing said sleeve.

3. Method according to claim 1, wherein said metallic coating is produced by electrolysis.

4. Method according to claim 1, wherein said metallic coating consists of nickel.

5. Method according to claim 1, wherein said metallic coating has a thickness of about one-tenth of a millimeter.

6. Method according to claim 2, wherein said zone (14) in which said metallic coating (20) is produced covers the part of said tube (12) in which said sleeve (18) is diametrically expanded and transition zones (17, 17') between a deformed part of said tube and non-deformed parts of said tube, during crimping of said sleeve (18).

7. Method according to claim 2, wherein the zone of said inner surface of said tube (12) in which said metallic coating (20) is produced extends up to a part of said tube (12) located inside said tube plate (10).

8. Method according to claim 1, wherein said tube (22) is crimped over only part of the length of said hole (23) passing through said tube plate (24), and wherein said tubular casing consists of said tube (22) itself and said metallic coating (30) is produced and additional crimping of said tube (22), in a zone (27) of said tube (220 located inside said hole (23) is performed.

* * * * *